US010143306B2

(12) United States Patent
Bock

(10) Patent No.: US 10,143,306 B2
(45) Date of Patent: Dec. 4, 2018

(54) MECHANISM FOR AN OFFICE CHAIR

(71) Applicant: BOCK 1 GMBH & CO. KG, Postbauer-Heng (DE)

(72) Inventor: Hermann Bock, Pyrbaum (DE)

(73) Assignee: BOCK 1 GmbH & Co. KG, Postbauer-Heng (DE)

( * ) Notice: Subject to any disclaimer, the term of this patent is extended or adjusted under 35 U.S.C. 154(b) by 188 days.

(21) Appl. No.: 15/217,250

(22) Filed: Jul. 22, 2016

(65) Prior Publication Data

US 2017/0020290 A1 Jan. 26, 2017

(30) Foreign Application Priority Data

Jul. 22, 2015 (DE) ..... 10 2015 111 946

(51) Int. Cl.
*A47C 1/024* (2006.01)
*A47C 1/032* (2006.01)
*A47C 7/00* (2006.01)

(52) U.S. Cl.
CPC ..... *A47C 1/03266* (2013.01); *A47C 1/03255* (2013.01); *A47C 1/03272* (2013.01); *A47C 1/03294* (2013.01); *A47C 7/004* (2013.01)

(58) Field of Classification Search
CPC ..... A47C 7/004; A47C 1/03255; A47C 1/03266; A47C 1/03272; A47C 7/44; A47C 1/022; A47C 7/40; A47C 7/448
USPC ... 297/300.2, 314, 300.5, 302.1, 313, 354.1, 297/285, 292, 293, 294, 295, 296, 297, 297/298, 299
See application file for complete search history.

(56) References Cited

U.S. PATENT DOCUMENTS 4,966,411 A * 10/1990 Katagiri ..... A47C 1/0325 297/300.3
5,150,948 A * 9/1992 Volkle ..... A47C 1/03255 297/300.5
5,209,548 A * 5/1993 Locher ..... A47C 1/03255 297/300.4
5,397,165 A * 3/1995 Grin ..... A47C 1/03255 297/300.5
6,234,573 B1 5/2001 Roeder et al.
6,238,000 B1 * 5/2001 Hallmark ..... A47C 1/03238 297/300.5
6,709,057 B2 * 3/2004 Sander ..... A47C 1/03255 297/300.1
6,896,329 B2 * 5/2005 Sander ..... A47C 1/03255 297/300.1

(Continued)

FOREIGN PATENT DOCUMENTS

CH 702970 A2 10/2011
DE 102014104870 A1 10/2015
JP H0231530 U 2/1990

*Primary Examiner* — Chi Q Nguyen
(74) *Attorney, Agent, or Firm* — Laurence A. Greenberg; Werner H. Stemer; Ralph E. Locher

(57) ABSTRACT

A mechanism for an office chair has a base support which is placeable on a chair column. A seat support is arranged on the base support and is movable relative to the base support. A backrest support is coupled with the seat support. Pivoting the backrest causes the seat support to move relative to the base support. An alternative solution for adjusting the tilting resistance of the seat support of an office chair is provided where the tilting resistance of the seat support is influenced by the pivoting resistance of the backrest support.

10 Claims, 4 Drawing Sheets

(56) References Cited

U.S. PATENT DOCUMENTS

| | | | | |
|---|---|---|---|---|
| 8,646,839 | B2 * | 2/2014 | Moreschi | A47C 1/03255 297/300.2 |
| 9,060,612 | B2 * | 6/2015 | Lee | A47C 7/14 |
| 2009/0212617 | A1 * | 8/2009 | Krob | A47C 1/03233 297/316 |
| 2009/0261642 | A1 * | 10/2009 | Dickie | A47C 7/446 297/314 |
| 2010/0084904 | A1 * | 4/2010 | Erker | A47C 1/03255 297/340 |
| 2015/0282620 | A1 | 10/2015 | Bock | |
| 2016/0331137 | A1 * | 11/2016 | Costaglia | A47C 1/03255 |

* cited by examiner

MECHANISM FOR AN OFFICE CHAIR

This application claims the priority, under 35 U.S.C. § 119, of German patent application DE 10 2015 111 946.3, filed Jul. 22, 2015; the prior application is herewith incorporated by reference in its entirety.

BACKGROUND OF THE INVENTION

Field of the Invention

The invention relates to a mechanism for an office chair having a base support which is placeable on a chair column, having a seat support which is arranged on the base support and is movable relative to the base support and having a backrest support which is coupled with the seat support. The pivoting of the backrest causes the seat support to move relative to the base support.

The use of such a mechanism, as is used as an assembly in the seat substructure of an office chair, provides kinematics which involve a certain relative movement of the seat and the backrest with respect to one another such that a correlated seat-backrest movement is produced. In this case, the seat and the backrest are pivoted down and to the rear together.

Numerous solutions for modifying the movement characteristics of such a mechanism are known in the prior art, in particular for modifying the pivoting resistance of the backrest. Usually, by means of an actuating element, for example a rotary handle or the like, an adjustment between "hard" and "soft" is chosen depending on whether the user of the office chair is a heavy person or a light person.

Over and above this, to improve the ergonomics of office chairs further, adjustability of the tilt of the seat is increasingly required. In this case, the seat, in the loaded state, should be able to assume a position that deviates from the horizontal position and is slightly tilted to the front.

The tilting resistance, against which the seat support is tilted when the office chair is sat upon, is not modifiable in the case of many embodiments known in the prior art. Light persons and heavy persons consequently always experience one and the same tilting resistance.

In the case of other solutions, the tilting resistance of the seat support is certainly adjustable. However, this is often achieved in a manner that is expensive structurally. Additional components increase the production and assembly costs and require corresponding installation space.

SUMMARY OF THE INVENTION

It is accordingly an object of the invention to provide a mechanism for a chair which overcomes the above-mentioned and other disadvantages of the heretofore-known devices and methods of this general type and which provides for an alternative solution for adjusting the tilting resistance of the seat support of an office chair.

With the above and other objects in view there is provided, in accordance with the invention, a mechanism for a chair. The mechanism includes:

a base support to be placed on a chair column;

a seat support connected to the base support and movable relative to the base support;

a backrest support connected to the base support and to the seat support and movable relative to the base support, wherein a pivoting of the backrest support causes the seat support to move relative to the base support, and a spring arrangement disposed to act between the backrest support and the seat support for determining a pivoting resistance of the backrest support;

the backrest support being pivotable relative to the base support against a spring force of the spring arrangement;

the seat support being tiltable relative to the base support against the spring force of the spring arrangement, and the spring arrangement determining a tilting resistance of the seat support.

A basic concept of the invention is to provide a seat support which is tiltable forward from the horizontal against the spring force of a spring arrangement which cooperates with the seat support, the same spring arrangement also cooperating with the backrest support. The spring arrangement which is used for adjusting the pivoting resistance of the backrest support is utilized, in other words, for adjusting the tilting resistance of the seat support. As a result of choosing the hinge points of the spring arrangement on the seat support and on the backrest support as well as choosing suitable structural realizations, it is consequently possible to adjust the pivoting characteristics of the seat in a simple manner and to adapt them to the pivoting characteristics of the backrest.

As a result of modifying the spring force default setting of the spring arrangement, the tilting resistance of the seat support is consequently adjusted to be stronger or weaker at the same time and is consequently adapted to different body weights of the users.

When the seat is sat upon, the seat support, preferably by using a suitable movable coupling element between the base support and the seat support, is lowered in its front region against the spring force of the spring arrangement and, correspondingly, when the weight is removed from the seat, the seat support is automatically aligned or raised into its starting position again with the help of the spring force. In other words, when the seat is sat upon and in particular when the body weight is displaced on the seat support, the seat support is rocked or swung into the seat tilt position and out of the seat tilt position. This results in a comparatively "dynamic" sitting feeling for the user of the chair.

Said movement into the seat tilt position or out of the seat tilt position is not brought about according to the invention using a spring that is responsible for this on its own; instead of this, the main spring of the mechanism, which is primarily responsible for the pivoting of the backrest, is used. The invention therefore not only provides a particularly dynamic seat tilt functionality. Said functionality is also achieved with minimum structural expense, in particular without additional spring elements. The production and assembly costs are reduced as a result.

It is particularly advantageous that a default setting of the spring force of the spring arrangement with regard to the weight of the user directly affects the seat tilt functionality. In the case of heavy users who require greater backrest pivoting resistance, the spring action for the seat tilt is also harder such that a stronger spring action for lowering into the seat tilt position is automatically produced. The higher the pivoting resistance setting of the backrest, the greater also the tilting resistance of the seat. Consequently, the seat is able to be rocked or swung into the seat tilt position equally for all weights of users and it is felt by all users equally, irrespective of their weight, if the mechanism, in particular the spring arrangement of the mechanism, is adjusted in a suitable manner to the user.

In this case, the manner in which the spring arrangement is adjusted, for example manually and/or self-adjusting in dependence on the weight of the user, is insignificant.

The basic concept of the invention is independent of the specific movement carried out by the seat support relative to the base support. As a rule, however, the movement of the seat support is a movement in the seat longitudinal direction which is superimposed by a tipping, pivoting and/or tilting movement of the seat support.

Other features which are considered as characteristic for the invention are set forth in the appended claims.

Although the invention is illustrated and described herein as embodied in a mechanism for an office chair, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

None of the figures show the invention true to scale, in this case they are only shown schematically and with their essential components. Identical references in this case correspond to elements with identical or comparable functions.

Figure 1:
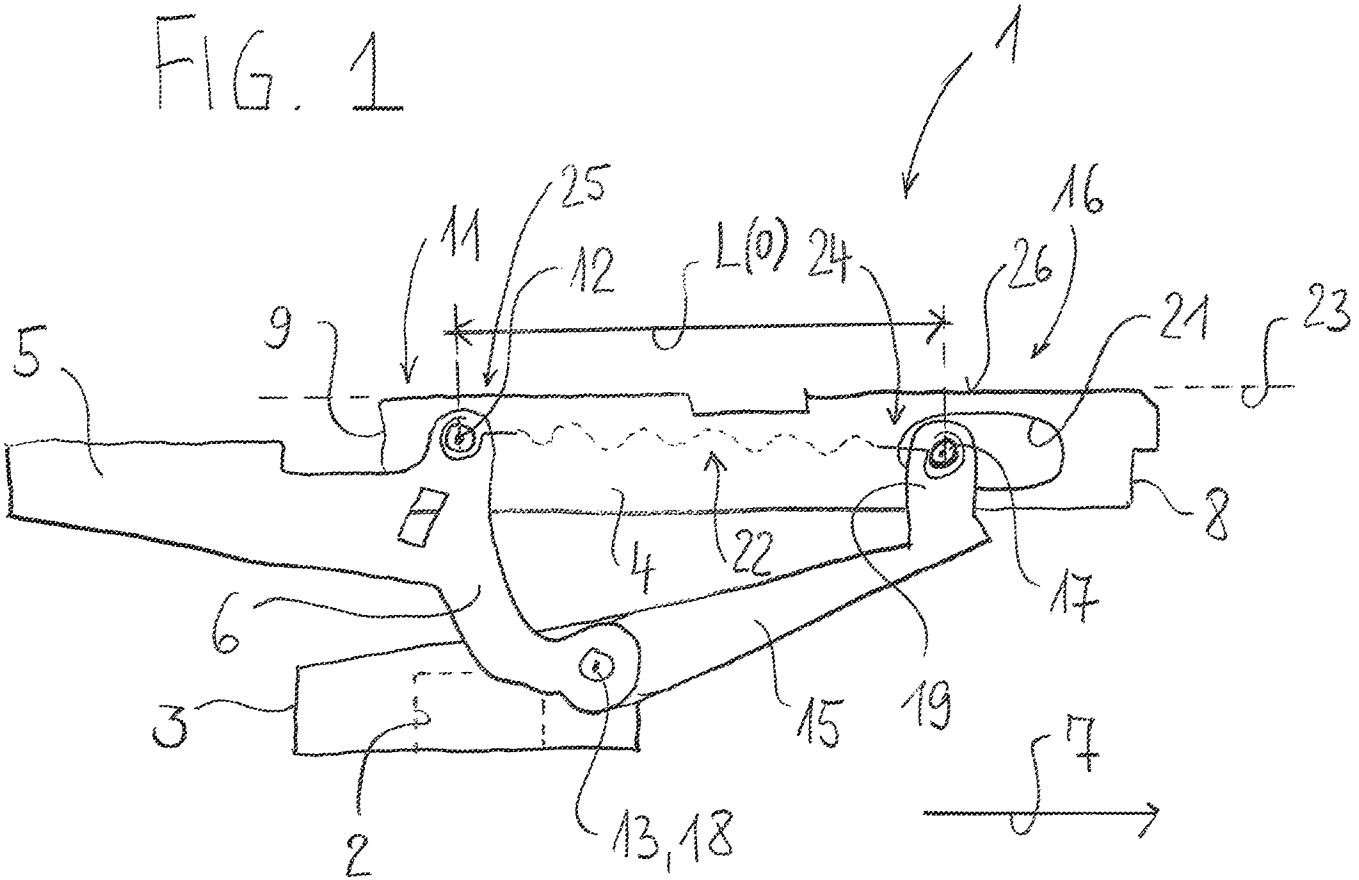
FIG. 1 shows a side view of the mechanism according to the invention in the non-loaded state.

In a preferred embodiment of the invention, the mechanism 1 for an office chair includes a preferably fixed base support 3 which can be placed onto the top end of a chair column (not shown) by way of a conical receiving means 2 which is depicted in FIG. 1.

It further includes a seat support 4 which is connected to the base support 3 and is movable relative to the base support 3, the seat support 4 being connected neither directly nor immediately to the base support 3. The seat (not shown) of the office chair, which is provided as a rule with a padded seating surface, is mounted on the seat support 4.

The mechanism 1 further includes a backrest support 5 which is connected to both the base support 3 and the seat support 4 and is movable relative to the base support 3. Pivoting the backrest support causing the seat support 4 to move relative to the base support 3. The cheeks 6 of the backrest support 5, which are bifurcated in top view, are arranged on both sides of the base support 3.

The mechanism 1 is designed in a mirror-symmetrical manner with reference to the center longitudinal plane, which relates to the actual kinematics. In this respect, the assumption in the following description is always that structural elements of the mechanism 1 are present in pairs on both sides.

"At the front" or "front" in this case means that a component is arranged at the front in the seat longitudinal direction 7 or relates to a component which extends in the direction of the front seat edge 8 or points in said direction, while "at the rear" or "rear" means that a component is arranged at the rear in the seat longitudinal direction 7 or relates to a component which extends in the direction of the backrest or of the backrest support 5 or of the rear seat edge 9 or points in said direction. The specifications "up" or "down" relate to the intended usage of the office chair or of the office chair mechanism 1.

In a preferred embodiment of the invention, for realizing a first connection between the seat support 4 and the base support 3, the backrest support 5 is pivotally hinged both on a rear end 11 of the seat support 4, namely with the free ends of its cheeks 6 in the vicinity of the conical receiving means 2 thereby realizing a first seat support pivot axis 12 which extends transversely to the seat longitudinal direction 7, and on the base support 3, namely on a region of its cheeks 6 which is at a spacing from the free ends thereby realizing a first base support pivot axis 13 which extends transversely to the seat longitudinal direction 7, wherein pivoting the backrest support 5 down and to the rear, i.e. from an upright starting position into a rear pivoting position, in the pivoting direction 14 causes the seat support 4 to move relative to the base support 3. The manner in which the pivotable backrest support 5 is coupled with the seat support 4 only plays a minor role for the present invention. In this case, as in the present case, this can be a direct but also an indirect coupling.

Over and above this, the mechanism 1 includes coupling elements 15 which are arranged on both sides of the base support 3, in this case in extension of the cheeks 6 of the backrest support 5, and which extend forward from the base support 3 in the direction of the front edge 8 of the seat support 4. To realize a second connection between the seat support 4 and the base support 3, each coupling element 15 is pivotally hinged on both a front end 16 of the seat support 4, namely by realizing a second seat support pivot axis 17 which extends transversely with respect to the seat longitudinal direction 7, and on the base support 3, namely by realizing a second base support pivot axis 18 which extends transversely with respect to the seat longitudinal direction 7. The front ends of the coupling elements 15 run out into two arms 19 which end on both sides of the seat support 4. The coupling elements 15 are connected there, for example, to structural elements arranged in the interior of the seat support 4, the maneuverability of the coupling elements 15 in relation to the seat support 4 in the seat longitudinal direction 7 being ensured by openings 21 in the manner of elongated holes. In other cases, the coupling elements 15 are connected to the seat support 4, for example by realizing rotating/sliding joints.

Spring elements, which interact directly or indirectly with the backrest or the backrest support 5, have to be provided so that the backrest is able to perform a defined pivoting movement. The pivoting resistance of the backrest when pivoting from a starting position into a pivoting position and the corresponding resetting force of the backrest are determined by said spring elements.

Accordingly, the mechanism 1 includes a spring arrangement 22 which acts between the backrest support 5 and the seat support 4. The type of the spring arrangement 22 as well as the type of the possible adjustment of the spring arrangement 22 are not crucial to the present invention. Consequently, the spring arrangement 22 is simply indicated in a symbolic manner in the figures, see FIG. 1. In a simple case, for example, the spring arrangement 22 can be a number of helical springs. It is preferably one or several screw tension springs, the spring ends of which are fastened on the seat support pivot axes 12, 17. However, other spring elements or spring assemblies with several spring elements can also be used.

The pivot points of the spring elements of the spring arrangement 22 are determined by their connections to the backrest support 5 or the seat support 4. In a simple case, the spring elements are suspended into the seat support pivot axes 12, 17 by way of their ends. All the pivot axes 12, 13, 17, 18, preferably however at least the seat support pivot axes 12, 17, are realized as physical axes.

When the seat support 4 is loaded by a user, the seat support 4 is tiltable in relation to the horizontal 23 relative to the base support 3 against the spring force of the spring arrangement 22. In other words, the seat support 4 cooperates with a first end 24 of the spring arrangement 22 during tilting. As a result of the tilting, the spring arrangement 22 is therefore acted upon by the first end 24 of the spring arrangement 22 being moved away from the oppositely located second end 25 of the spring arrangement 22.

The backrest support 5 is pivotable relative to the base support 3 against the spring force of the spring arrangement 22. In other words, the backrest support 5 cooperates with the second end 25 of the spring arrangement 22 during the pivoting of the backrest support 5. The spring arrangement 22, the spring force of which determines the pivoting resistance of the backrest support 5, determines, together with the weight of the user, the severity of the tilt of the seat support 4. If a user sits down on the chair, the seat support 4 is then tilted against the spring force of the spring arrangement 22. At the same time, the resetting force of the spring arrangement 22 causes the seat support 4 to move in part or completely out of the seat tilt position into its starting position when the user removes his weight in part or completely from the seat support, that is to say either moves on the seat or stands up from the seat.

In the seat tilt position, the weight of the user is displaced forward in the seat longitudinal direction. On account of the weight displacement, leaning back against the backrest at the same time is ruled out. If the user wishes to lean against the backrest, he will displace his weight rearwards first of all in the seat longitudinal direction. The seat support 4 is then displaced again into its starting position. In other words, the seat support 4 springs back into its starting position before the backrest is able to pivot. In other words, the seat support 4 is then situated in a substantially horizontal position, in spite of a user sitting on the chair. Matching the pivoting movement of the seat support 4 and of the backrest support 5 to one another in this way using suitable structural means and introducing a neutral state of equilibrium to be run through forcibly by the user, in which neither the seat support 4 nor the backrest support 5 are pivoted out of their starting positions, ensures that it is impossible for the seat support 4 and the backrest support 5 to be pivoted simultaneously.

In a preferred embodiment of the invention, the spring force of the spring arrangement 22 is adjustable. The spring arrangement 22 is able to be manually pre-set, preferably in the non-loaded state, i.e. without a user sitting on the chair. Changing the spring force default setting of the spring arrangement 22 is significant with a view to subsequently tilting the seat support 4. By adjusting the default setting, it is possible to adjust not only the pivoting resistance of the backrest support 5 but also the seat tilting resistance to a certain user, more precisely to the weight of the certain user. At the same time, it is possible to adjust the chair mechanism 1 to a certain user group in this way, for example as a result of a corresponding adjustment ex-factory. However, it is also possible to change the spring force setting several times during the use of the office chair.

The device for changing the pretension is preferably an adjusting device with a track element, as is described in my commonly assigned, published patent application US 2015/0282620 A1 and its counterpart German published patent application DE 10 2014 104 870.9.

As a result of simply adjusting the pretension of the spring arrangement 22, in conjunction with arranging the individual components of the mechanism 1 in a suitable geometric manner with respect to one another, in particular arranging the hinge points and pivot axes 12, 13, 17, 18, in particular the spacing between the same, it is possible in a particularly simple manner to adjust the entire synchronous movement of the office chair mechanism 1 and to obtain the desired neutral state of equilibrium between inclining a seat and pivoting the backrest.

In a preferred embodiment of the invention, the spring arrangement 22 acts between the seat support pivot axes 12, 17. In other words, the ends 24, 25 of the spring elements used cooperate with the seat support pivot axes 12, 17.

In a preferred embodiment of the invention, the position of the second seat support pivot axis 17, and consequently the position of the hinge point of the coupling element 15 on the seat support 4, is modifiable in the seat longitudinal direction 7, namely when the seat support 4 is tilted and/or when the backrest support 5 is pivoted in the pivoting direction 14.

Figure 2:
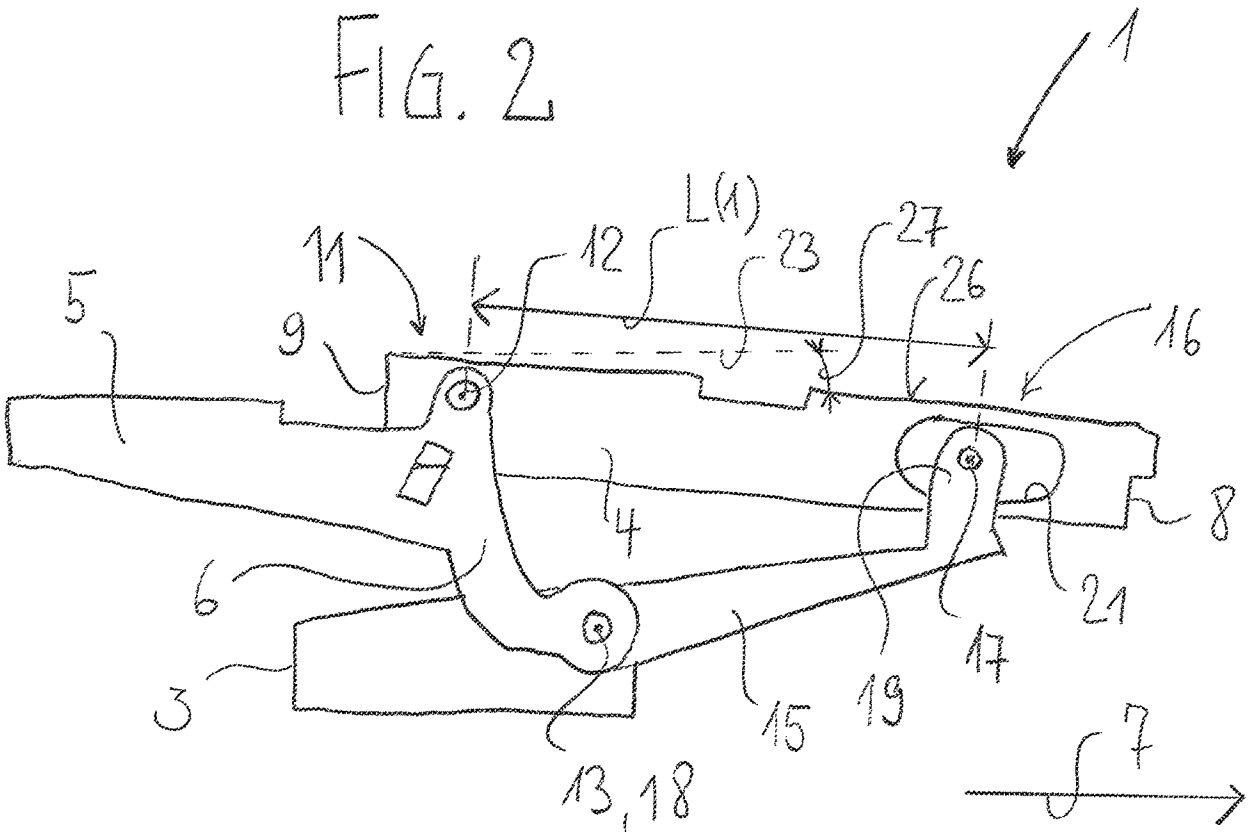
FIG. 2 shows a side view of the mechanism in FIG. 1 with a loaded seat.

In a preferred embodiment of the invention, the mechanism 1 is realized in such a manner that the seat support 4 being loaded by a user sitting down, and at the same time the coupling element 15 being pivoted, namely the front, movable arm 19 of the coupling element 15 being lowered, results in the front edge 8 or the front part 16 of the seat support 4 being lowered, as well as in the hinge point 17 of the coupling element 15 on the seat support 4 being displaced forward in the seat longitudinal direction 7, see FIG. 2.

The pivoting resistance of the backrest support 5 and the resultant seat tilting resistance are produced from the spacing L(0) between the pivot points of the spring arrangement 22, in this case therefore of the seat support pivot axes 12, 17 in the non-loaded state.

The spring elements of the spring arrangement 22 are acted upon when the seat support 4 is tilted and consequently when the seat support 4 moves relative to the base support 3. The tension spring is tensioned. The spring travel covered in this connection $\Delta L = L(1) - L(0)$ is dependent on the pre-set pretension of the spring arrangement 22 as well as on the weight of the user.

In the case of said first movement, the seat support 4 does not move in the seat longitudinal direction 7. The seat support 4 is simply tilted. From a starting position, in which the seat support 4, more precisely the top surface 26 thereof and consequently the seat mounted thereon (not shown), is situated in the horizontal 23, the seat support 4 is tilted forward in relation to the horizontal 23 by an angle of tilt 27 of, for example, 5°. If the seat support 4 is situated in such a tilted position, the front edge 8 of the seat support 4 is then lower than the rear edge 9 of the seat support 4, see FIG. 2.

Prior to pivoting of the backrest support 5, the seat support 4 is situated in its non-tilted starting position into which it is retracted by the spring arrangement 22 when the user stands up or bends rearward to lean against the backrest.

Figure 3:
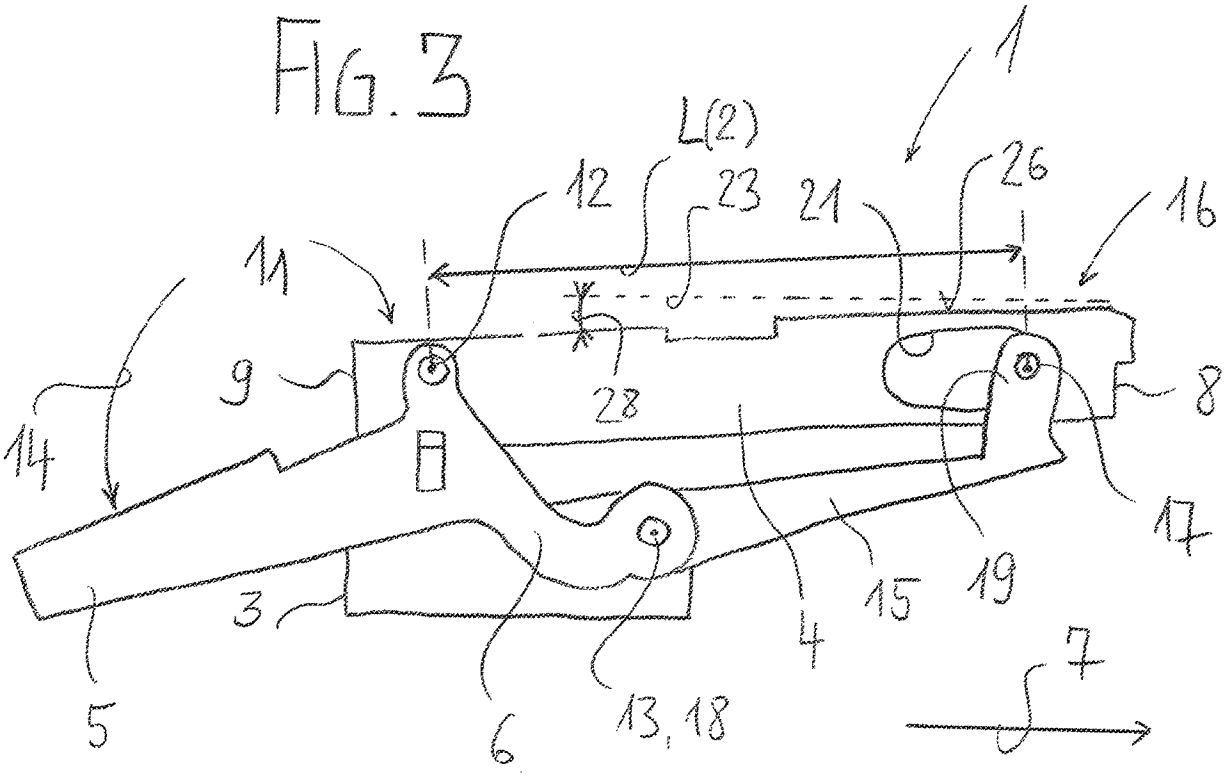
FIG. 3 shows a side view of the mechanism in FIG. 1 with a loaded seat and a loaded backrest.
Figure 4:
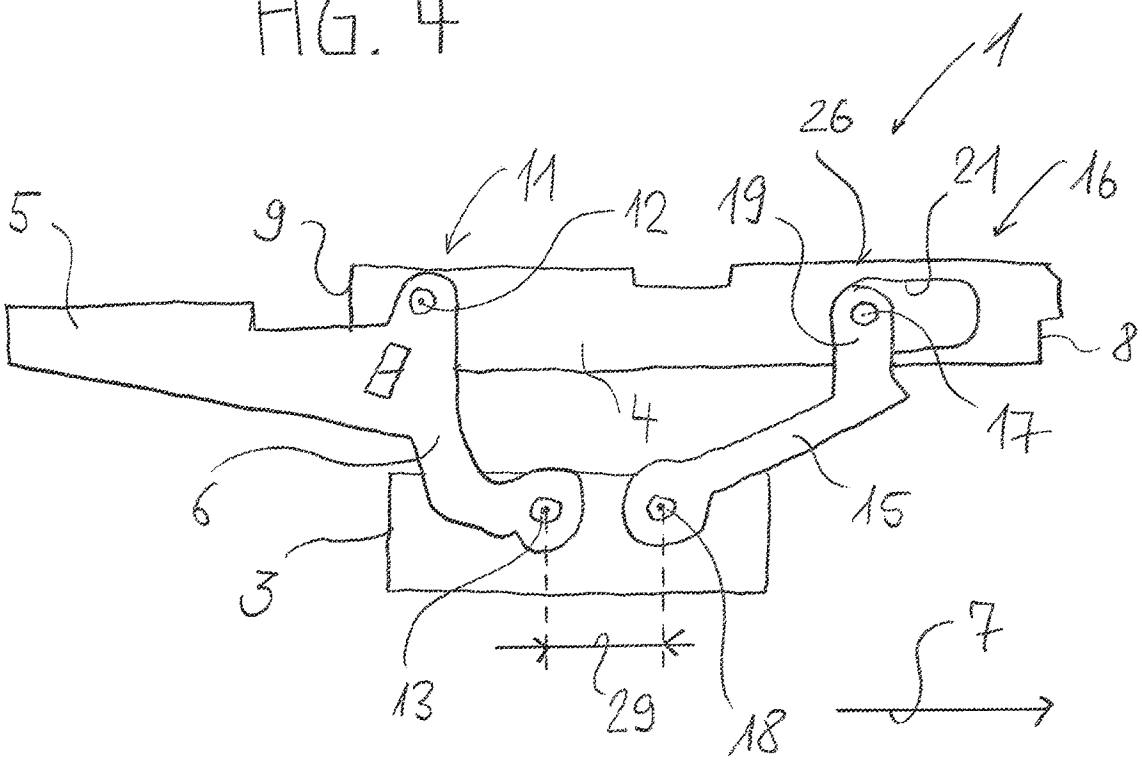
FIG. 4 shows a side view of a further embodiment of the mechanism according to the invention in the non-loaded state.

In a preferred embodiment of the invention, the mechanism 1 is realized in such a manner that the backrest support 5 being loaded by the user leaning against the backrest, with the backrest support 5 being pivoted at the same time, results in the rear edge 9 or the rear part 11 of the seat support 4 being lowered, as well as the hinge point 17 of the coupling element 15 on the seat support 15 being displaced forward in the seat longitudinal direction 7, see FIG. 3. The hinge point 17 of the coupling element 15 on the seat support 4, in this case, is displaced further forward in the seat longitudinal direction 7 than in the seat tilt position.

In this process, the seat support 4 executes a movement rearward in the seat longitudinal direction 7 at the same time. In other words, the seat support 4 is moved downward to the rear, more precisely is pulled by the backrest support 5. The seat support 4, in this case, is pivoted in such a manner that the seat support 4, more precisely the top surface 26 thereof and consequently the seat mounted thereon (not shown), is tilted rearward and has an angle of tilt 28 of, for example, 5° in relation to the horizontal 23. With the backrest support 5 pivoted as far to the rear as possible, the rear edge 9 of the seat support 4 is consequently lower than the front edge 8 of the seat support 4.

When the backrest support 5 is pivoted and consequently the seat support 4 moved relative to the base support 3, the spring elements of the spring arrangement 22 are acted upon once again. The spacing L(2) between the pivot points 12, 17 of the spring arrangement 22 increases in relation to the spacing L(0) of the non-pivoted position of the backrest support 5 and is also greater than the spacing L(1) between the pivot points 12, 17 in the seat tilt position. The spring travel covered $\Delta L = L(2) - L(0)$ is dependent on the pivot angle of the backrest.

In a preferred embodiment of the invention, the two base support pivot axes 13, 18 extend in a coaxial manner. In other words, the hinge point 13 of the backrest support 5 on the base support 3 corresponds to the hinge point 18 of the coupling element 15 on the base support 3, see FIGS. 1 to 3.

If the distance between axes 29 is equal to zero, there is therefore simply one single common axis of rotation 13, 18 present on the base support 3, producing a mechanism 1 that is designed in a particularly simple manner structurally.

In another preferred embodiment of the invention which is an alternative to this, the two base support pivot axes 13, 18 are spaced apart from one another in the seat longitudinal direction 7. In other words, the hinge point 13 of the backrest support 5 on the base support 3 is arranged offset in the seat longitudinal direction 7 to the hinge point 18 of the coupling element 15 on the base support 3. The pivot axes 13, 18 are spaced apart from one another.

In the case of the present spacing between axes 29, the ratio of the pivoting resistances, namely of the pivoting resistance of the backrest support 5 and of the seat tilting resistance of the seat support 4, can be modified by choosing the spacing between axes 29 in a suitable manner. As a result of a more or less large spacing between axes 29, it is possible, in other words, to match the proportionality of the pivoting resistances to a specific design of mechanism. It is possible in this way to pre-set the mechanism 1 for certain target groups in a particularly simple manner.

All the features shown in the description, the subsequent claims and the drawing can be fundamental to the invention both on their own and in arbitrary combination with one another.

The following is a summary list of reference numerals and the corresponding structure used in the above description of the invention:

1 Mechanism
2 Conical receiving means
3 Base support
4 Seat support
5 Backrest support
6 Cheek
7 Seat longitudinal direction
8 Front seat edge
9 Rear seat edge
11 Rear end of the seat support
12 First seat support pivot axis
13 First base support pivot axis
14 Pivot direction
15 Coupling element
16 Front end of the seat support
17 Second seat support pivot axis
18 Second base support pivot axis
19 Front end of the coupling element
21 Opening
22 Spring arrangement
23 Horizontal
24 First end of the spring arrangement, first pivot point
25 Second end of the spring arrangement, second pivot point
26 Top surface of the seat support
27 First angle of tilt
28 Second angle of tilt
29 Spacing between axes

The invention claimed is:

1. A mechanism for an office chair, comprising:
a base support to be placed on a chair column;
a seat support connected to said base support and movable relative to said base support;
a backrest support connected to said base support and to said seat support and movable relative to said base support, wherein a pivoting of said backrest support causes said seat support to move relative to said base support, and
a spring arrangement disposed to act between said backrest support and said seat support for determining a pivoting resistance of said backrest support;
said backrest support being pivotable relative to said base support against a spring force of said spring arrangement;
said seat support being tiltable relative to said base support against the spring force of said spring arrangement, and said spring arrangement determining a tilting resistance of said seat support;
a coupling element disposed to movably connect said base support and said seat support; and
said backrest support being pivotally hinged:
on a rear end of said seat support, thereby defining a first seat support pivot axis which extends transversely with respect to a seat longitudinal direction; and
on said base support, thereby defining a first base support pivot axis which extends transversely with respect to the seat longitudinal direction; and
pivoting said backrest support causes said seat support to move relative to said base support; and
said coupling element being pivotally hinged:
on a front end of said seat support, thereby defining a second seat support pivot axis which extends transversely with respect to the seat longitudinal direction; and
on said base support, thereby defining a second base support pivot axis which extends transversely with respect to the seat longitudinal direction.

2. The mechanism according to claim 1, wherein the spring force of said spring arrangement is adjustable, rendering the pivoting resistance of said backrest support and the tilting resistance of said seat support modifiable.

3. The mechanism according to claim 1, wherein said spring arrangement is disposed to act between the first and second seat support pivot axes.

4. The mechanism according to claim 1, wherein a position of the second seat support pivot axis is modifiable when said seat support is tilted or when said backrest support is pivoted in the seat longitudinal direction.

5. The mechanism according to claim 4, wherein loading said seat support causes a lowering of the front edge of said seat support as well as displacing the hinge point of said coupling element on said seat support forward in the seat longitudinal direction.

6. The mechanism according to claim 4, wherein loading said backrest support results in lowering the rear edge of said seat support as well as in displacing the hinge point of said coupling element on said seat support forward in the seat longitudinal direction.

7. The mechanism according to claim 6, wherein said first and second base support pivot axes extend coaxially.

8. The mechanism according to claim 6, wherein said first and second base support pivot axes are spaced apart from one another in the seat longitudinal direction.

9. The mechanism according to claim 1, wherein said first and second base support pivot axes extend coaxially.

10. The mechanism according to claim 1, wherein said first and second base support pivot axes are spaced apart from one another in the seat longitudinal direction.

* * * * *